US006450292B1

(12) United States Patent
Sheffield

(10) Patent No.: US 6,450,292 B1
(45) Date of Patent: Sep. 17, 2002

(54) LADDER LEVELLING DEVICE

(75) Inventor: Lance Rodney Sheffield, Sevenoaks (GB)

(73) Assignee: Sandpiper Construction Limited, Canterbury (GB)

( * ) Notice: Subject to any disclaimer, the term of this patent is extended or adjusted under 35 U.S.C. 154(b) by 0 days.

(21) Appl. No.: 09/554,637

(22) PCT Filed: Nov. 18, 1998

(86) PCT No.: PCT/GB98/03465

§ 371 (c)(1),
(2), (4) Date: May 17, 2000

(87) PCT Pub. No.: WO99/25947

PCT Pub. Date: May 27, 1999

(30) Foreign Application Priority Data

Nov. 18, 1997 (GB) ..... 9724398

(51) Int. Cl.[7] ..... E06C 1/00; E06C 7/00
(52) U.S. Cl. ..... 182/205; 182/200
(58) Field of Search ..... 182/200, 201, 182/202, 203, 204, 205; 248/188.2, 188.3

(56) References Cited

U.S. PATENT DOCUMENTS

| | | | | | |
|---|---|---|---|---|---|
| 769,419 | A | * | 9/1904 | Wagner | 182/204 X |
| 891,729 | A | * | 6/1908 | Phipps | 182/205 |
| 2,147,052 | A | * | 2/1939 | Nonne | 182/205 |
| 2,405,269 | A | * | 8/1946 | Prutsman | 182/205 |
| 2,458,076 | A | * | 1/1949 | Houston | 182/205 |
| 3,016,103 | A | * | 1/1962 | Studer | 182/204 X |
| 3,233,703 | A | | 2/1966 | Feltrop | 182/202 |
| 3,484,814 | A | * | 12/1969 | Meehan | 182/204 |
| 3,527,321 | A | * | 9/1970 | Brown | 182/205 |
| 3,882,966 | A | * | 5/1975 | Fasano | 182/205 |
| 4,014,406 | A | * | 3/1977 | Easton | 182/204 |
| 4,984,655 | A | * | 1/1991 | Scherer et al. | 182/204 |
| 5,678,656 | A | | 10/1997 | Lanzafame | 182/205 |
| 5,718,306 | A | * | 2/1998 | Baker | 182/204 |

FOREIGN PATENT DOCUMENTS

| | | | | |
|---|---|---|---|---|
| JP | 08068283 | * | 3/1996 | 182/205 X |

* cited by examiner

*Primary Examiner*—Daniel P. Stodola
*Assistant Examiner*—Hugh B. Thompson
(74) *Attorney, Agent, or Firm*—David Silverstein; Andover-IP-Law

(57) ABSTRACT

A ladder levelling device which is simply operated by person's foot, embodying stile extender (7) either inserted into hollow stile (1) or removably attached to side of solid stiles of ladders or stepladders. Consisting of outer fixed housing, internal telescopic extender (7) and ratched mechanism, with teeth (20) in the extender (7) engaging with teeth (23) attached to an arm (21) which can rock about a pivot (4) in the housing to disengage the opposing teeth (20). A roller (15) or low friction device attached to the arm (21) between the teeth (23) and the pivot (4) disengages the teeth (23) during extending to reduce wear. A cam (12) attached either directly or indirectly to the opposing end of the arm (21) enables retraction and acts as safety device that prevents movement in either direction. A foot (30) is attached to base of expander by a spindle **(31*b*)** which allows limited universal movement and is capable of being locked in position.

19 Claims, 10 Drawing Sheets

LADDER LEVELLING DEVICE

This invention relates to a combined ladder or stepladder levelling device with locking foot assembly which can be used so that ladders and stepladders can be safely used on non-level ground.

The problems associated with the use of ladders etc. on uneven or sloping ground are well documented with many patent applications having been made in an attempt to get over the problems involved. Yet even with the wealth of technical innovation in this area, there are still no effective ladder levelling devices on the market. The present invention overcomes the difficulties by integrating, ease of use, simple operation and minimum projections from the lines of the ladder stiles combined with low manufacturing/assembly costs and capability of being easily fitted to a very wide range of ladder types.

It is known to have extensions slidably mounted within the hollow stiles of a ladder which can be pulled out and locked in position and by this means the length of each stile of a ladder can be independently varied.

However these are difficult to use requiring awkward or difficult adjustments to be made whilst trying to erect and position the ladder. Another problem is that with ladders commonly made of extruded aluminium any ratchet or similar device made from similar materials is very prone to wear in use and can consequently fail. Harder materials are either too costly or suffer from corrosion problems.

I have devised an improved ladder stile extension device allowing a ladder to be correctly positioned whatever the slope of the ground and which is easier to use in practice.

According to the invention there is provided a device for adjusting the length of a stile of a ladder which device comprises a ladder extender able to be slidably attached to a stile of a ladder in which device there is a ratchet means which comprises a first rack fixed relative to the stile and a second rack attached to the extender, whereby the teeth of the first and second racks can engage with each other in use to prevent the extender from retracting, there being a disengagement means being able to be operated to disengage the teeth of the first and second racks from each other, which disengagement means incorporates a contact means which can engage with the teeth of the second rack, with the contact means being in contact with and passing over the teeth of the second rack when there is relative opening movement between the first and second racks, but which does not operate to disengage the teeth when an outside force is exerted on the end of the extender in an attempt to retract it.

The disengaging means can incorporate a roller attached to and adjacent to the first rack, which roller, by engaging with the teeth of the second rack lifts the first rack clear and disengages the opposing sets of teeth during the extending operation.

Alternatively the disengaging means can comprise a pad of low friction material which, by engaging with the teeth of the second rack, lifts the first rack clear and disengages the opposing sets of teeth during the extending operation and, being of low friction, minimises the wear on the teeth as it passes over them.

Preferably on the lower end of the extender is mounted a foot component that allows movement in two directions, maintaining the adequate transfer of loads to the ground whatever the slope of the ground, with up to 10 to 12 degrees of crossfall accommodated.

Preferably the first rack has an opposing lever arm as an extension and the rack is pivotally mounted about a pivot whereby pressure adjacent the end of the lever arm will cause the rack to rock or rotate about the pivot and disengage the teeth of the first rack from the teeth of the second rack.

With a number of teeth in the first rack at close centres, small incremental movement of extender's telescopic action can be achieved.

Preferably the main components of the device will be constructed of extruded sections. The design of the extruded sections allows the incorporation of the lever arrangement generally without special machining operations.

A conventional ratchet design arrangement, although naturally allowing incremental opening movement would result in excessive wear on the ratchet teeth, particularly to the teeth located on the lever arm closest to the centre of rotation. To prevent this and allow the use of soft aluminium extrusions to form both the rotating lever arm and the teeth, a roller arrangement or low friction device (plastic block) is built into the lever, close to the pivot that automatically lifts the opposing teeth clear during movement—extending the device, but which, as with a simple ratchet prevents the reverse motion closing the device.

A compression or other flat spring acting on the lever arm provides a positive pressure to ensure the positive interlocking of the two sets of teeth. An operating knob is preferably mounted externally to the device, either connected directly to the lever arm or via a connecting rod, to allow manual operation, extension or retraction as well as providing a safety catch arrangement, preventing accidental retraction of the device whilst in service.

The use of a rotating lever could be substituted by a device that maintains the first rack in a position perpendicular or square with the second racket reducing uneven wear of the components.

Generally the upper unit fixed relative to the ladder stile is constructed of a hollow extrusion which totally surrounds and provides stability to the lower movable unit which is formed from either an H or C shaped extrusion. Greater strength can be provided to the movable unit when in the extended position by either one or two further H or C shaped extrusions that interlock with the main telescopic extrusion to form effectively a hollow unit rather than an open sided component. This also serves to protect the ratchet components from the ingress of dirt etc.

All pins spindles and the like within the upper or lower units are restrained in their longitudinal direction i.e. transverse or perpendicular to the line of the main extrusions by either the main extrusions or other further extrusions linked to same thereby avoiding the use of nuts or end clips to maintain accurate positioning and alignment.

Many of the auxiliary components within the device can be made by cutting suitably shaped aluminium extrusion into short lengths 10 mm–30 mm long thereby utilising the accuracy and intricacy capable, with the extrusion process, without resorting to excessive machining and other expensive metal fabrication processes. Should production quantities be such so as to warrant greater initial capital expense then some of these subsidiary components could be formed in cast aluminium or of high strength plastics by injection moulding.

The whole device can be mounted, either within the lower end stile section of a hollow aluminium ladder, or attached to the side of ladders whether constructed of timber or aluminium. Generally there would be one such device mounted to the lower ends of each ladder stile (two in total) and four such devices mounted to the lower ends of the legs of stepladders. Though when attached to the side of stile or leg of the units can be made removable allowing a 50% reduction in numbers required for effective and safe operation.

When a ladder is used on uneven or sloping ground and one of the stiles fails to make proper contact with the ground causing the ladder to lean sideways, making it therefore unstable and unsafe. With this device fitted, levelling of the ladder is very easily achieved by simply extending the inner lower component of the device with the person's foot while holding the ladder stiles with both hands in the correct vertical orientation. With the retracting/safety knob (safety knob) in the released position, the internal ratchet arrangement allows small incremental adjustment of foot position without the operator having to release hand grip on the ladder. When fully adjusted the ladder is then safe to use, and to ensure that the operating lever handle is not accidentally knocked, the safety knob is rotated into the locked position, preventing any further telescopic action in either direction.

With the device mounted internally within the stiles of a hollow aluminium ladder below the lowest tread it is possible to obtain approximately 70 mm of vertical movement, enough to adjust for a greater than 10 degree cross fall. When mounted externally to ladder or stepladder greater adjustment is possible as the device can be made longer using the same basic extrusions and components. In these circumstances it would be possible to obtain vertical adjustment in excess of 250 mm allowing the ladder or stepladder to be used in safety, on steps and the like.

Load from the ladder is transferred to the ground via a foot unit incorporating a shaped spindle that permits the foot to be rotated sideways in addition to the usual fore aft movement thereby accommodating slopes and crossfalls. A locking device can be included within the spindle that enables the orientation of the foot to be fixed or locked at any angle within the operating range. This locking action also prevents the feet from vibrating when being transported on the roof of vehicles.

When the ground is soft the surface area of the feet can be increased with a slip on boot.

Retraction of the device is achieved either under the action of a return spring when one is fitted or manually when no such spring is installed. The safety knob is first released and then depressed releasing the sets of ratchet teeth allowing the moving section to retract under the action of the return spring, or to be pushed back manually.

A plastic material pad can be included on the rotating lever that bears when fully depressed on the vertical ratchet assembly thereby acting as a simple brake. preventing retraction in an uncontrolled manner.

Preferably the release mechanism can be operated by a person's foot so that, when utilised, the user can hold the ladder with his hands and slide the extender out to the desired length e.g. by pressing down on the foot of the extender until contact with the ground is achieved.

To retract the device the release mechanism can again be operated by a person's foot whilst holding the ladder and allowing weight of the ladder to push back the extender until the foot on the opposing stile reaches the ground. When the ladder is laid horizontally the device can be pushed back by hand.

The invention is described with reference to the accompanying drawings in which.

Figure 1A:
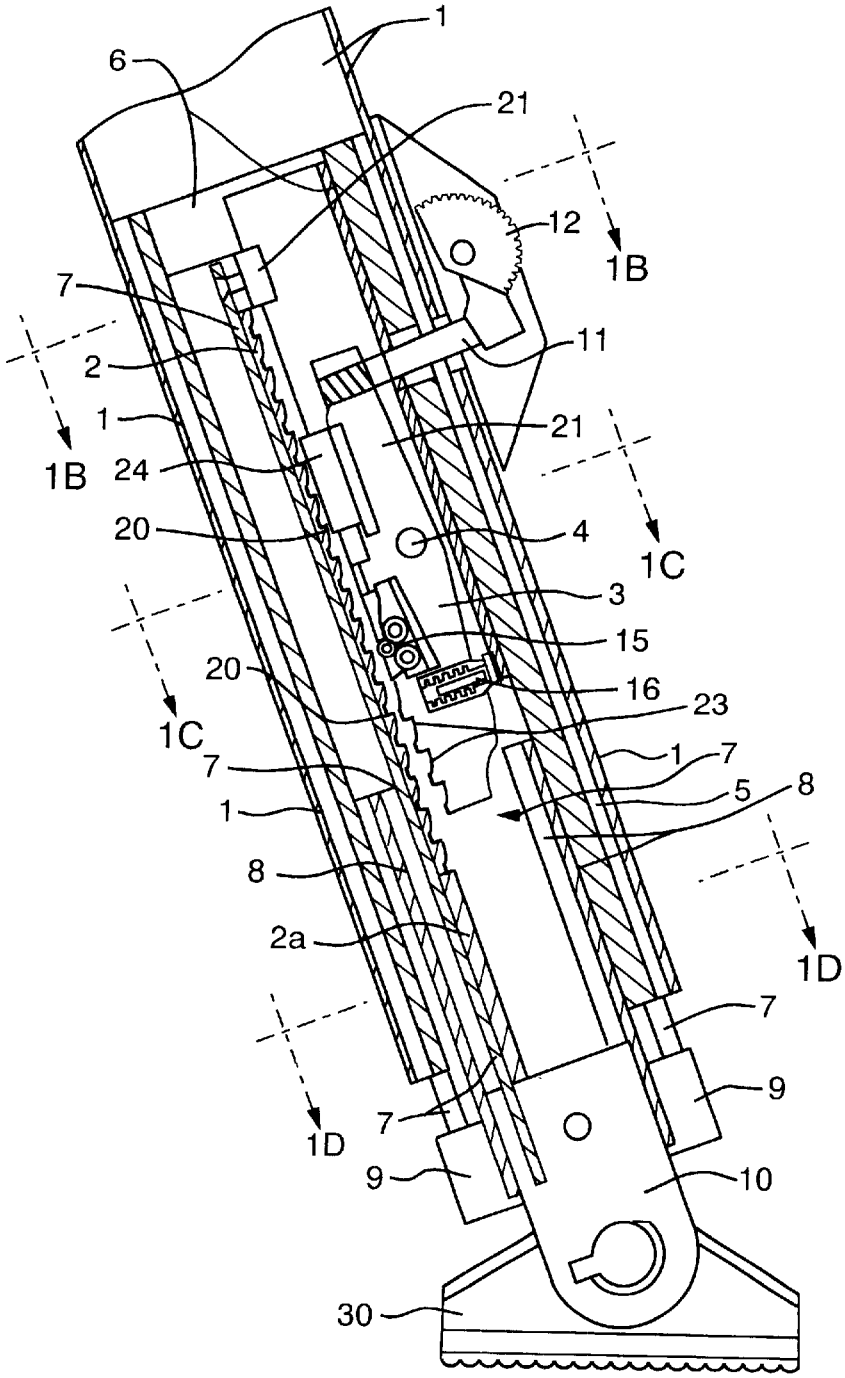
FIG. 1A shows the device mounted within the hollow aluminium stile of a ladder below the lowest tread. The drawing shows the operation of the internal roller mechanism lifting the ratchet teeth cl movement with FIGS. 1B, 1C and 1D showing cross sections along the lines 1—1, 2—2, 3—3, and respectively.
Figure 1B:
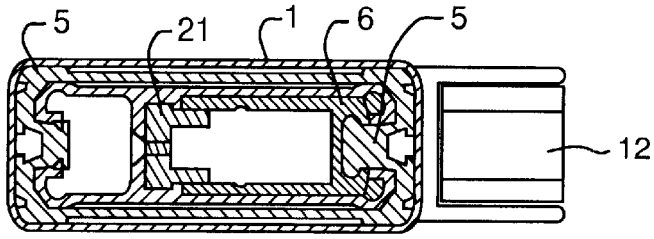
Figure 1C:
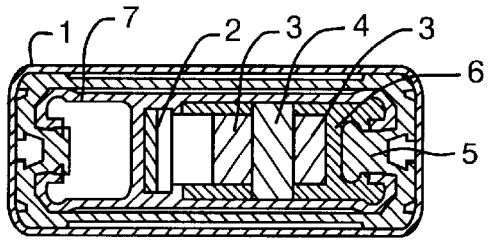
Figure 1D:
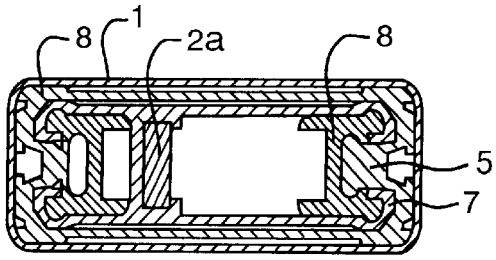

FIGS. 6A, 6B, 7, 8A, 8B, 9A, 9B, and 10A–C show details of alternative foot arrangements.

A ladder has a hollow stile (1) made of extruded aluminium and a hollow ladder extender (7) is slidably mounted inside (1) within a hollow extruded casing (5). There is a rack element (2) having teeth (20) located within grooves formed in (7) as shown.

The rack is prevented from moving upwards in grooves of (7) by a block (21) that also acts as a limit stop preventing the extender (7) from extending beyond service range. There is rocking rack element (3) which comprises toothed portion (23) and a lever arm extension portion (21), which is pivoted about pivot (4). Pivot (4) is supported by carrier extrusion (6) that is connected to hollow extruded casing (5) and fixed relative to hollow stile (1). A bolt (11) is slidably mounted through stile (1) and (5) is fixed to lever arm (21) and is operated by rotating cam (12) against the action of spring (16) which acts to keep teeth (20) and (23) engaged. Roller (15) is attached to (3) as shown. At the lower end of (7) is an end cap (9) incorporating a projection to the side allowing user foot operation. The foot unit of the device (30) is connected to via (10) that is a tight sliding fit with (7) and pivots about spindle (31).

Figure 2A:
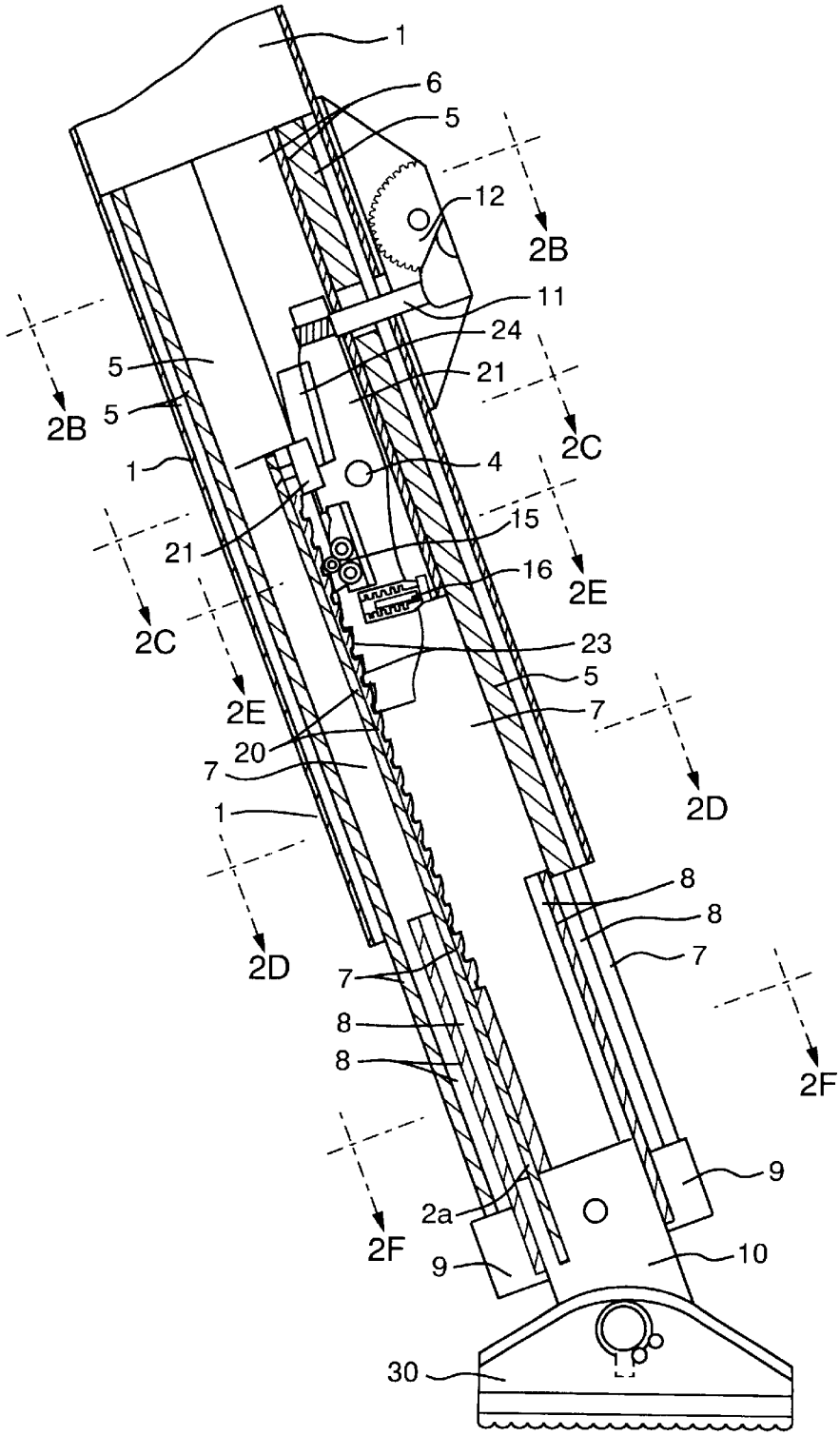
FIG. 2A shows the same device in the fully extended and in locked position with FIGS. 2B, 2C, 2D, 2E, and 2F showing cross sections along the lines 5—5, 6—6, 7—7, 8—8 and 9—9 respectively.
Figure 2B:
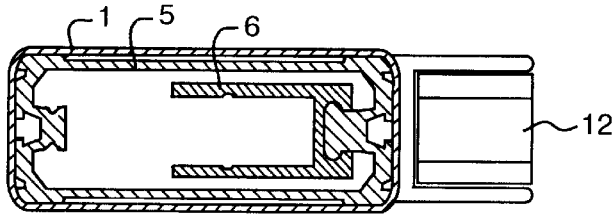
Figure 2C:
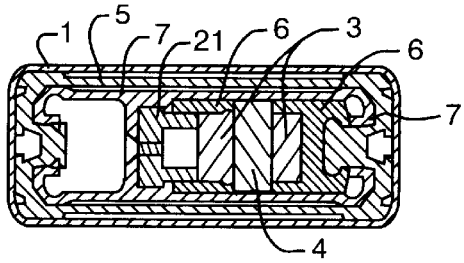
Figure 2D:
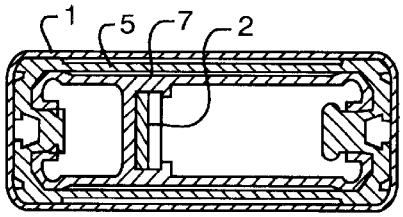
Figure 2E:
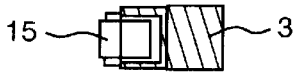
Figure 2F:
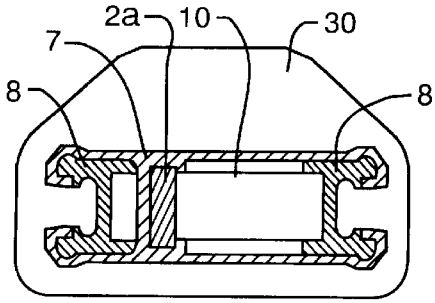

As shown in FIG. 1A when the device is to be extended the cam safety device (12) is rotated, allowing bolt (11) to move and arm (3) to rock about pivot (4) and the teeth (20) and (23) to disengage, the extender (7) can then be extended from the stile by pressure from the user's foot on (9). During this operation it can be seen that the roller arrangement (15) attached to (3) being closer to the centre of rotation (4), ill roll over the teeth (20) and therefore lift the ratchet teeth (23) clear of (20). In FIG. 2A it will be seen that, when in the locked position, there is a nominal gap between the roller (15) and the projecting tooth of (20) below whilst resting on the shoulder of the tooth above. This arrangement ensures that with any movement of (7) in the downward direction the opposing teeth of the ratchet are immediately separately, but upward movement of (7) is prevented as roller (15) is separated from the tooth below by the nominal gap ensuring that the teeth remain engaged. The inertia effect of rocking action of arm (3) ensures that during the normal downward movement of (7) the tips of the opposing teeth of (20) and (23) don't actually touch. Any touching that occurs during very slow movement of (7) will be limited to the teeth of (23) closest to the point of rotation, the resulting limited wear on the tips of these teeth will not affect the overall operation of the device.

The triple roller arrangement is used in this instance to allow the use of a nylon type plastic roller in contact with the ratchet teeth with two supporting rollers to transfer the loads and reduce wear on the rollers and spindles and to allow the unit to be fabricated easily prior to installation within arm (3).

When it has extended to the desired position the bolt is released and the spring (16) causes the teeth (20) and teeth (23) to engage and the extender is locked in position. Rotating cam safety device (12) locks arm (3) in position and prevents movement of extender in either direction.

When the extender (7) is to be retracted the cam (12) is rotated and then depressed, pushing on (11) and rotating arm (3) thereby lifting ratchet teeth (23) completely clear of (20) allowing movement of (7). The plastic brake pad (24) attached to (3) bears on the ratchet teeth (20) preventing sudden uncontrolled movement of (7).

There are a number of possible variations in foot arrangement depending upon the materials used in their construction:

1. Free to move version
2. Locking version delineated by suffix a.
3. Injected moulded plastic version delineated by suffix b.

Figure 3A:
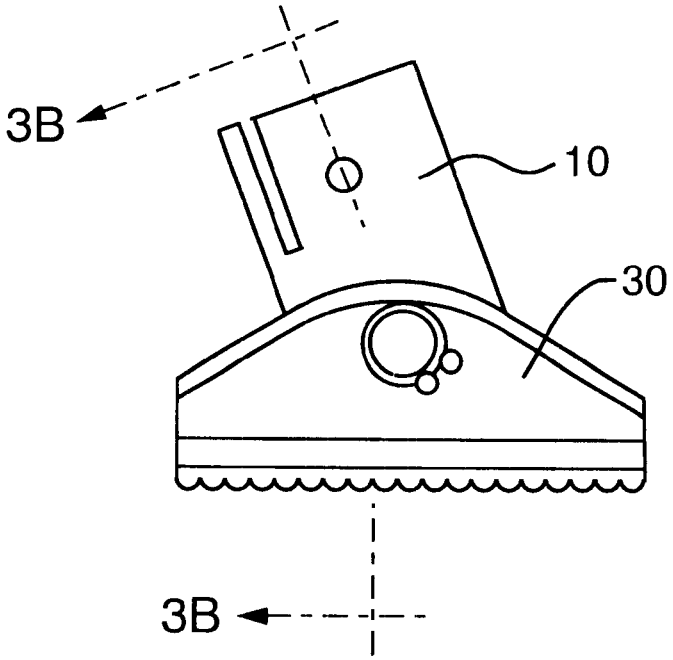
FIGS. 3A and 3B show lower foot details.
Figure 3B:
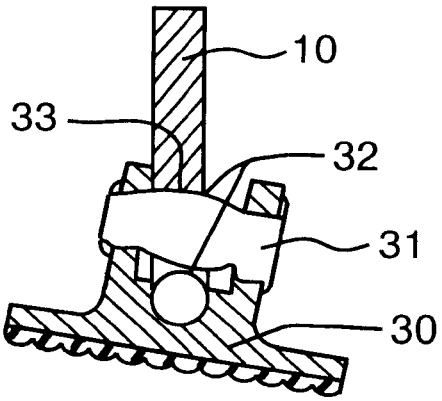

With version 1. Free to move version (Section 4—4 of FIGS. 2A and 3A) the spindle (31) is a component with the central section has a complex convex curved longitudinal cross section (32). The spindle (31) has ends of different diameter to allow it to be inserted though the hole in (10) and (30) when (10) is at angle as shown. There is a matching concave curve section machined into the upper half of the formed hole in the extruded section of (10). The lower portion of (10) below the hole is machined to form a section of torus ring of uniform circular cross section. This formed hole is slightly elliptical in cross section to allow an accurate mating surface in all positions. This arrangement provides a universal type joint utilising just the single spindle that allows the degree of freedom to accommodate a 10 degree crossfall across the width of the ladder.

Figure 4A:
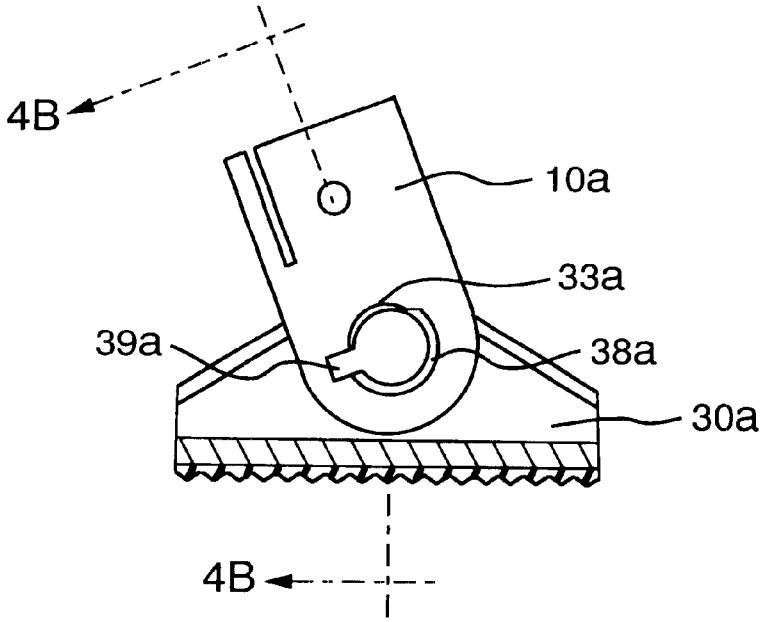
FIGS. 4A and 4B show alternative lower foot details with locking capability.
Figure 4B:
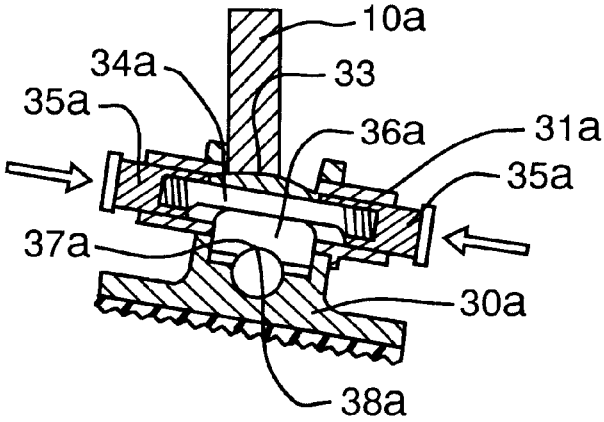
Figure 5:
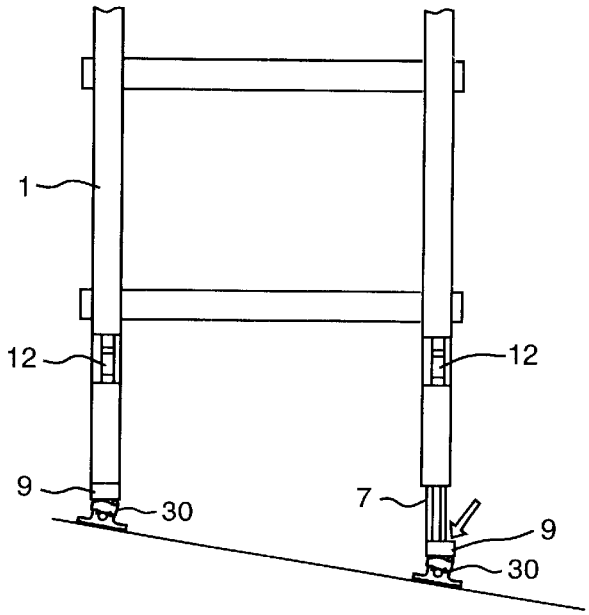
FIG. 5 shows the device installed within hollow stiles of ladder resting on sloping ground.

The locking version (Section 4*a*—4*a* of FIG. 4A) is similar except that the spindle (31*a*) is hollow and longer in order to accommodate a double ended bolt with a tapered central section (34*a*). This is moved sideways via end plungers (35*a*) as shown by the arrows, this movement forces the key (36*a*) with a double curved lower surface (37*a*) to mate with a matching double curved surface (38*a*) machined in to the lower half of the formed hole in the extruded section (10*a*). The additional formed cut out (39*a*) in (10*a*) is to allow installation of the key when unit (10*a*) in placed in the horizontal position.

An all injected moulded plastic version shown in FIGS. 6 to 9A requires variations to the previous examples to allow adequate transfer of loads from the levelling device through the foot to the ground.

Figure 6A:
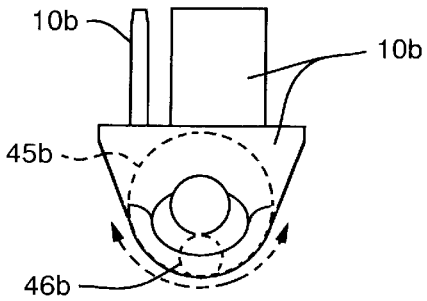
Figure 6B:
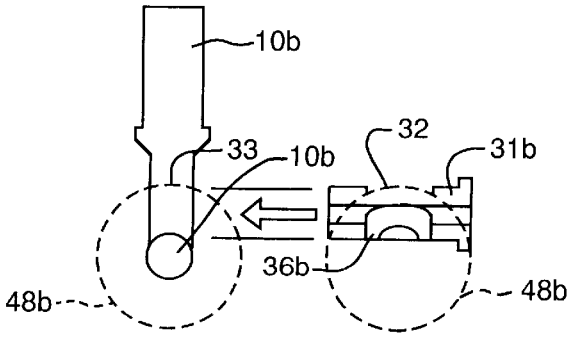

FIGS. 6A and 6B show (10*b*) formed of two sections, the upper being inserted into the extruded sections of the levelling device while the lower half connects to the foot component (30). Between these two sections is a solid bearing surface to transfer the loads between (10*b*) and the extruded sections above. The spindle (31*b*) has a hole running along its length together with a housing to accommodate a shaped key (36*b*).

Figure 7:
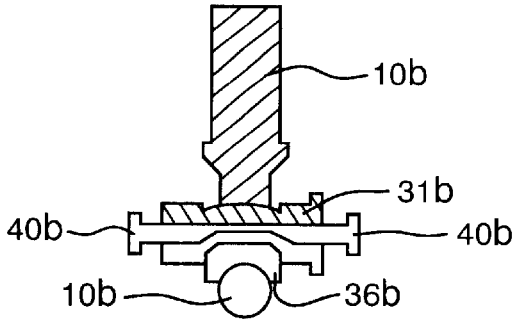

The top surface of the spindle (31*b*) has a curved surface corresponding to part of the outer surface of a torus ring of radius (48*b*) with cross section matching the main section of the spindle (31*b*). When the spindle is inserted through the hole in (10*b*) the gap is filled by expanding the key (36*b*) by the insertion of two shaped wedges (40*b*) as shown in FIG. 7.

Figure 8A:
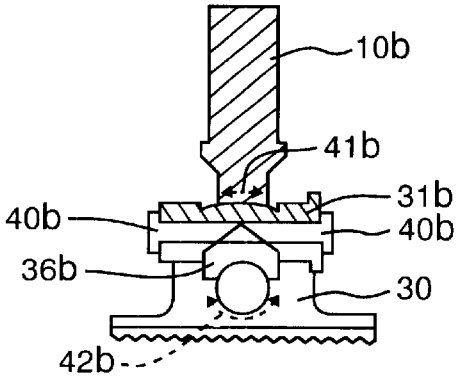
Figure 8B:
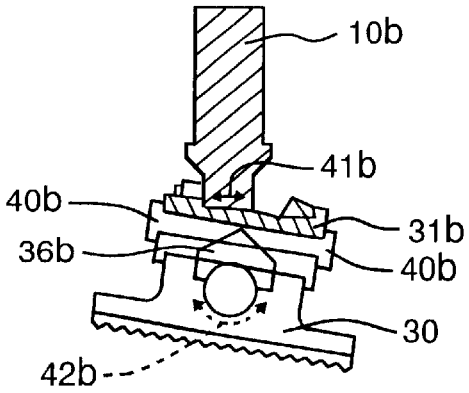

FIGS. 8A and 8B show the cross section of the complete foot assembly in different operating conditions. Load transfer between (10*b*) and the foot (30) is achieved at (41*b*) and (42*b*).

Figure 9A:
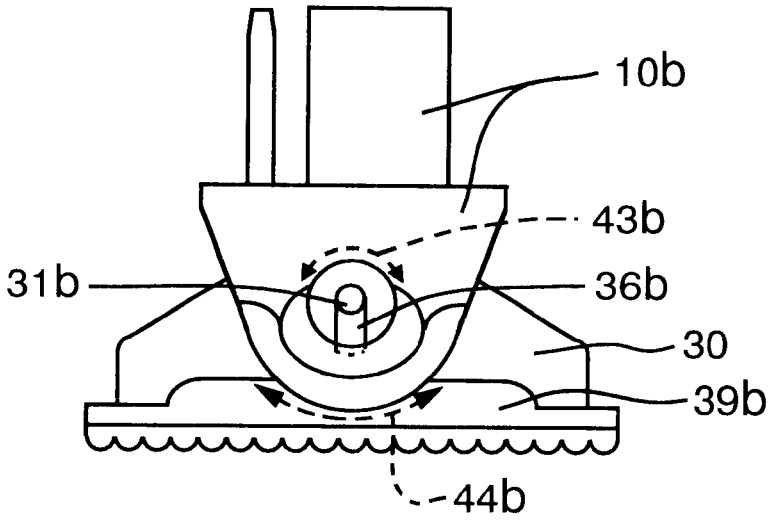
Figure 9B:
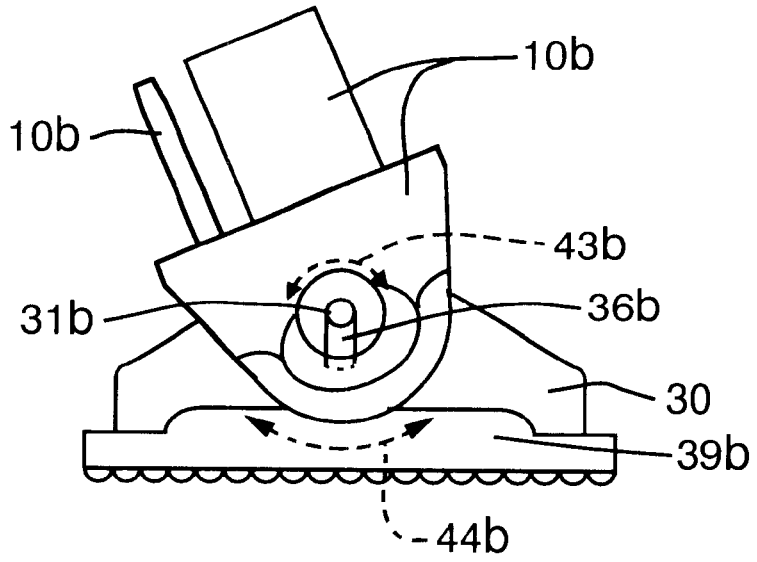

FIGS. 9A and 9B show the longitudinal cross section of the complete foot assembly in different operating conditions. Load transfer between (10*b*) and the foot (30) is achieved at (43*b*) and (44*b*). The foot (30) has an increased thickness of base plate (39*b*) which has a recess in it (44*b*) which is of complex geometric shape to accommodate the various possible movements of (10*b*).

Figure 10A:
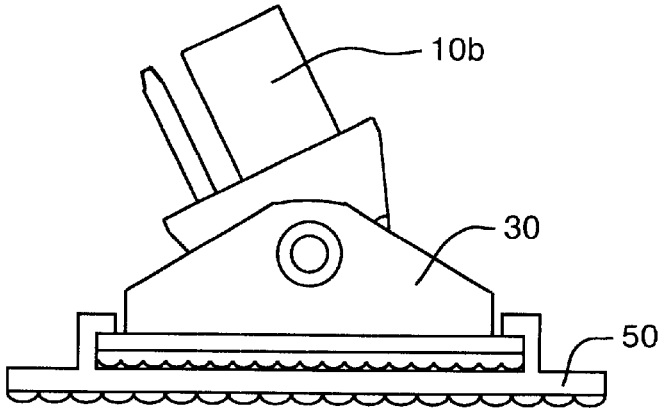
Figure 10B:
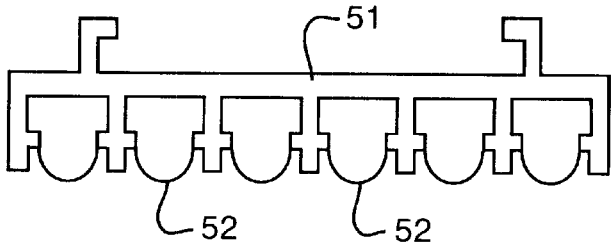
Figure 10C:
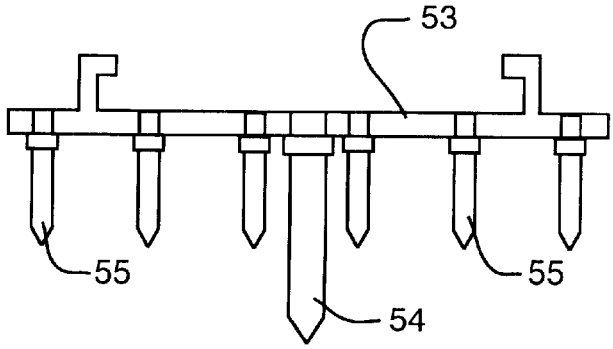

As shown in FIG. 10A, the area of the foot component (30) in contact with the ground can be increased by using an extruded boot (50) with rubber friction pad attached. This will allow the ladder to be used when the ground is soft.

To counteract slipping forces imposed on the foot due to the sloping angle of the ladder the slip on boot could consist of a composite construction utilising the properties of both aluminium and rubber to provide greater adhesion in a greater range of operating conditions. The slip on boot consisting of an extruded core (51) with replaceable rubber pads (52).

When used on grass or similar surfaces the slip on boot could have a single spike (54) attached or alternatively a number of smaller spikes (55) as shown.

What is claimed is:

1. The ladder extender device for adjusting the length of a stile of a ladder wherein said device comprises: a ladder extender able to be slidably attached to a stile of a ladder, said ladder extender including a ratchet element which comprises a first rack fixed, in use, relative to the stile and a second rack attached to said ladder extender, said first and second racks each including teeth,whereby the teeth of the first and second racks can engage with each other in use to prevent said ladder extender from retracting from being extended; and disengagement means able to operate to disengage the teeth of the first and second tracks from each other, said disengagement means incorporates a component for engagement with the teeth of the second rack, said component being in contact with and passing over the teeth of the second rack when there is relative opening movement between the first and second racks, but said disengagement means does not operate to disengage the teeth when an outside force is excerted on an end of said ladder extender in an attempt to retract said ladder extender.

2. The ladder extender device according to claim 1, wherein the contact means comprises a roller attached to and adjacent to the first rack, which roller can engage with the teeth of the second rack with the roller being in contact with and passing over the teeth of the second rack.

3. The ladder extender device according to claim 2, adapted to be attached to the outside of a stile of the ladder.

4. The ladder extender device according to claim 2, adapted to be attached to the outside of a stile of a stepladder.

5. The ladder extender device according to claim 2, adapted to be slidably fitted within a hollow stile of the ladder.

6. The ladder extender device according to claim 2, adapted to be slidably fitted within a hollow stile of a stepladder.

7. The ladder extender device according to claim 1, wherein the contact means comprises a pad of low friction material attached to and adjacent to the first rack, which low friction material can engage with the teeth of the second rack with the roller being in contact with and passing over the teeth of the second rack.

8. The ladder extender device according to claim 1, wherein the first rack has a lever arm extension and is pivotally mounted about a pivot whereby pressure adjacent the end of the lever arm will cause the first rack to rotate about the pivot and disengage the teeth of the first rack from the teeth of the second rack.

9. The ladder extender device according to claim 8, further comprising a spring means for excerting a force on said ladder extender whereby, when said ladder extender is extended by any amount, actuating the disengagement means will cause said ladder extender to retract under the action of the spring means.

10. The ladder extender device according to claim 8, further comprising a spring means for excerting a force on said ladder extender acting to urge the teeth of the first and second racks to remain engaged and further comprising a bolt slidably passing through the stile of the ladder and which can be operated from outside the ladder as a means of applying said pressure adjacent the end of the lever arm and in which pressure on the bolt acts against the section of a spring.

11. The ladder extender device according to claim 10, further comprising a cam which can rotate to act on the end of the bolt causing the bolt to apply pressure to the end of the lever arm and in which the cam can be fixed in position to keep the teeth of the first and second racks engaged.

12. The ladder extender device according to claim 8, further comprising a cam which can rotate to act directly on the end of the lever arm and in which the cam can be fixed in position to keep the teeth of the first and second racks engaged.

13. The ladder extender device according to claim 1, further comprising a spring means for excerting a force on said ladder extender whereby, when said ladder extender is extended by any amount, actuating the disengagement means will cause said ladder extender to retract under the action of the spring means.

14. The ladder extender device according to claim 1, further wherein, at the end of said ladder extender is a foot pivotally attached to said ladder extender by a spindle and which is able to move about the spindle in two directions while allowing effective load transfer through the joint, the spindle comprising a first curved section attached to an end of said ladder extender to form a closed loop and a second curved section attached to the foot which second curved section fits within the closed loop so as to connect said ladder extender to the foot and to provide the spindle.

15. The ladder extender device according to claim 14, further wherein the foot can be locked in position by a locking means.

16. The ladder extender device according to claim 1, adapted to be attached to the outside of a stile of the ladder.

17. The ladder extender device according to claim 1, adapted to be attached to the outside of a stile of a stepladder.

18. The ladder extender device according to claim 1, adapted to be slidably fitted within a hollow stile of the ladder.

19. The ladder extender device according to claim 1, adapted to be slidably fitted within a hollow stile of a stepladder.

* * * * *